US009805595B1

(12) United States Patent
Liebinger Portela et al.

(10) Patent No.: US 9,805,595 B1
(45) Date of Patent: Oct. 31, 2017

(54) VEHICLE AND NON-VEHICLE TRAFFIC FLOW CONTROL

(71) Applicant: INTERNATIONAL BUSINESS MACHINES CORPORATION, Armonk, NY (US)

(72) Inventors: Franz F. Liebinger Portela, San Pablo de Heredia (CR); Roxana Monge Núñez, San José (CR); Joseph M. Phillips, Jr., Philadelphia, PA (US); Edgar A. Zamora Duran, Santa Domingo (CR)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 7 days.

(21) Appl. No.: 15/335,970

(22) Filed: Oct. 27, 2016

(51) Int. Cl.
*G08G 1/01* (2006.01)
*G08G 1/07* (2006.01)

(52) U.S. Cl.
CPC ..... *G08G 1/0145* (2013.01); *G08G 1/07* (2013.01)

(58) Field of Classification Search
CPC ..... G08G 1/08; G08G 1/0145; G08G 1/07; G08G 1/0133; G08G 1/0129; G08G 1/01; G08G 1/0104
See application file for complete search history.

(56) References Cited

U.S. PATENT DOCUMENTS 5,521,826 A 5/1996 Matsumoto
5,539,398 A 7/1996 Hall et al.
6,064,319 A 5/2000 Matta
6,188,329 B1 * 2/2001 Glier ..... G07B 15/06
6,338,072 B1 1/2002 Durand et al.
(Continued)

FOREIGN PATENT DOCUMENTS

CN 203118230 U 10/2012
CN 203405954 U 1/2014
CN 103927866 A 7/2014

OTHER PUBLICATIONS

"Traffic signal preemption", Wikipedia, last modified May 11, 2016, 4 pgs.

(Continued)

*Primary Examiner* — Nay Tun
(74) *Attorney, Agent, or Firm* — Ronald A. Kaschak; Heslin Rothenberg Farley & Mesiti PC

(57) ABSTRACT

Traffic flow control. A method identifies traffic in an area. The traffic includes traffic objects. The identifying obtains identifiers of traffic objects in the area. Each traffic object is identified by a respective identifier of the traffic object identifiers. The method also dynamically assigns weights to the traffic objects based on pre-established traffic criteria. Each traffic object is assigned a respective weight of the dynamically assigned weights. The pre-established traffic criteria each include at least one weight value. The weight assigned to a traffic object is based on the weight values of a set of traffic criteria, of the pre-established traffic criteria, applicable to the traffic object and reflects a level of prioritization of a right-of-way of the traffic object. The method also controls flow of the traffic in the area. The controlling the flow includes controlling at least one traffic control signal based on the dynamically assigned weights.

20 Claims, 9 Drawing Sheets

(56) References Cited

U.S. PATENT DOCUMENTS

| | | | | |
|---|---|---|---|---|
| 6,633,238 | B2 | 10/2003 | Lemelson et al. | |
| 6,724,320 | B2 | 4/2004 | Basson et al. | |
| 7,973,675 | B2 * | 7/2011 | Glatfelter | G08G 1/01 340/907 |
| 8,090,532 | B2 | 1/2012 | Tashev et al. | |
| 8,666,643 | B2 * | 3/2014 | McBride | H04L 41/0823 340/907 |
| 8,884,783 | B2 | 11/2014 | Roberts et al. | |
| 8,928,493 | B2 * | 1/2015 | Mantalvanos | G08G 1/081 340/905 |
| 9,076,332 | B2 | 7/2015 | Myr | |
| 9,165,461 | B1 * | 10/2015 | Chu | G08G 1/0145 |
| 9,196,164 | B1 | 11/2015 | Urmson et al. | |
| 9,536,427 | B2 * | 1/2017 | Tonguz | G08G 1/087 |
| 2005/0134478 | A1 | 6/2005 | Mese et al. | |
| 2008/0094250 | A1 | 4/2008 | Myr | |
| 2008/0218380 | A1 * | 9/2008 | Wall | G08G 1/081 340/907 |
| 2009/0167561 | A1 | 7/2009 | Liang | |
| 2009/0256721 | A1 * | 10/2009 | Glatfelter | G08G 1/01 340/907 |
| 2011/0095908 | A1 * | 4/2011 | Nadeem | B60H 3/00 340/905 |
| 2011/0246055 | A1 | 10/2011 | Huck et al. | |
| 2013/0162449 | A1 | 6/2013 | Ginsberg | |
| 2014/0278029 | A1 * | 9/2014 | Tonguz | G08G 1/087 701/117 |
| 2015/0356868 | A1 * | 12/2015 | Cuende Alonso | G01C 21/36 382/104 |

OTHER PUBLICATIONS

Wheatley, Mike, "Big Data Traffic Jam: Smarter Lights, Happy Drivers", SiliconANGLE blog, Apr. 3, 2013, 4 pgs.

Runyoro, Angela-Aida K., "A Novel Real-Time Road Information Management Technique for Traffic Congestion Mitigation", Journal of Emerging Trends in Computing and Information Sciences, vol. 5, No. 8, Aug. 2014, pp. 624-631.

Rafidi, M.A. Ahmad, "Synchronization of Traffic Light Systems for Maximum Efficiency along Jalan Bukit Gambier, Penang, Malaysia", EDP Sciences, 2014, SHS Web of Conferences 11, 01006 (2014), 5 pgs.

* cited by examiner

| 102 | 104 | 106 | 108 | 110 |
|---|---|---|---|---|
| CRITERIA* | VARIABLE NAME | CATEGORIES* | PEDESTRIAN (PID) | VEHICLE (VID) |
| Weather | W | Bad conditions | W(p)= | W(v)= |
| | | Good conditions | W(p)= | W(v)= |
| Road Type | Rt | Highway | Rt(p)= | Rt(v)= |
| | | Primary road | Rt(p)= | Rt(v)= |
| | | Secondary road | Rt(p)= | Rt(v)= |
| Vehicle Type | Vt | Automobile | Vt(p)= | Vt(v)= |
| | | Bus | Vt(p)= | Vt(v)= |
| | | Taxi | Vt(p)= | Vt(v)= |
| | | Motorcycle | Vt(p)= | Vt(v)= |
| Priority | Pt | Police | Pt(p)= | Pt(v)= |
| | | Ambulance | Pt(p)= | Pt(v)= |
| | | Distinguished people | Pt(p)= | Pt(v)= |
| Infractions | | Infractions | I(p)= | I(v)= |

FIG. 1

VEHICLE AND NON-VEHICLE TRAFFIC FLOW CONTROL

BACKGROUND

Transportation is an important activity around the world because of its impact on the environment, economy, and well-being of individuals. Traffic jams affecting the foregoing are prevalent in many cities and other areas where control of the traffic is sub-optimal. Proper traffic control is a complex task that is increasing in complexity because of increasing numbers of traffic objects (vehicles, pedestrians, etc.) and their varying needs. Traffic disorder persists and efficient control of pedestrian traffic in conjunction with vehicular traffic has been left aside. Additionally, the realistic prospect of self-driving cars stems a demand for implementation of more friendly, adaptable, and powerful traffic control approaches.

Generally, traffic lights and other traffic control signals work based on historical records indicating time of day when there may be a situation that produces a change in traffic (especially accidents). Problems can arise when traffic control signals work with information that is out of date, potentially resulting in heavier traffic congestion and other issues. Meanwhile, real-time traffic information may be available online but not used to efficiently control traffic signals.

SUMMARY

Facilities are needed for synchronization providing more efficient traffic control of traffic objects through real-time traffic control signal decisions, e.g. utilizing GPS, application, and/or online information. Traffic objects refers to any form of physical traffic in or around roadways. Example traffic objects include, by are not limited to: motorized vehicles such as cars, trucks, busses, vans, motorbikes, motorcycles, and mopeds, and non-motorized traffic in/around the roadways, such as pedestrians, cyclists/bikers, skateboarders, and the like. Aspects described herein help to reduce overall traffic congestion and improve overall traffic flow efficiency for traffic objects, that include vehicles and pedestrians of varying levels of priority in terms of right-of-way.

Regulation of traffic objects (e.g. pedestrians and vehicles) is provided, in some embodiments, by assigning traffic objects a dynamic weight according to a set of characteristics of the traffic object, the available routes, and the environment. This weight enables, e.g., identification of priorities on specific routes, restrictions to areas, and optimization in route selection for traffic objects. The environment refers generally to the circumstances surrounding the desire for a traffic object to move from one location to another, and includes context around the traffic object, such as weather conditions and hazards in the roadway. For instance, priority in terms of traversing an intersection may be given to a pedestrian when weather is extremely rainy, on the basis that a pedestrian is likely more impacted than vehicle traffic based on this weather condition.

Aspects provide a means by which pedestrians, vehicles, and other traffic objects can be tagged and dynamically weighted to improve their traffic experience by analyzing their characteristics, needs, and the environment. Additionally, aspects provide for enforcement of correct driver behaviors and compliance with traffic laws. In some examples, a system assigns a dynamic weight to traffic objects of a roadway or roadway intersection according to a set of criteria each having a weight that may be modified dynamically and used to identify what priority to give to each traffic object going through the intersection. Priority may be used to guide the controls of the traffic control signal(s) controlling the intersection. In an example, a determination is made whether to expand the timeframe for the green light (or a red light) for one or more directions through the intersection.

Shortcomings of the prior art are overcome and additional advantages are provided through the provision of a computer-implemented method. The method identifies traffic in an area. The traffic includes traffic objects. The identifying includes obtaining traffic object identifiers of traffic objects in the area. Each traffic object of the traffic objects is identified by a respective traffic object identifier of the traffic object identifiers. The method also includes dynamically assigning traffic object weights to the traffic objects based on pre-established traffic criteria. Each traffic object is assigned a respective traffic object weight of the dynamically assigned traffic object weights. The pre-established traffic criteria each includes at least one weight value. The traffic object weight assigned to a traffic object of the traffic objects is based on the weight values of a set of traffic criteria, of the pre-established traffic criteria, applicable to the traffic object and reflects a level of prioritization of a right-of-way of the traffic object. The method further includes controlling flow of the traffic in the area. The controlling the flow includes controlling at least one traffic control signal based at least in part on the dynamically assigned traffic object weights.

Further, a computer program product including a computer readable storage medium readable by a processor and storing instructions for execution by the processor is provided for performing a method. The method identifies traffic in an area. The traffic includes traffic objects. The identifying includes obtaining traffic object identifiers of traffic objects in the area. Each traffic object of the traffic objects is identified by a respective traffic object identifier of the traffic object identifiers. The method also includes dynamically assigning traffic object weights to the traffic objects based on pre-established traffic criteria. Each traffic object is assigned a respective traffic object weight of the dynamically assigned traffic object weights. The pre-established traffic criteria each includes at least one weight value. The traffic object weight assigned to a traffic object of the traffic objects is based on the weight values of a set of traffic criteria, of the pre-established traffic criteria, applicable to the traffic object and reflects a level of prioritization of a right-of-way of the traffic object. The method further includes controlling flow of the traffic in the area. The controlling the flow includes controlling at least one traffic control signal based at least in part on the dynamically assigned traffic object weights.

Yet further, a computer system is provided that includes a memory and a processor in communications with the memory, wherein the computer system is configured to perform a method. The method identifies traffic in an area. The traffic includes traffic objects. The identifying includes obtaining traffic object identifiers of traffic objects in the area. Each traffic object of the traffic objects is identified by a respective traffic object identifier of the traffic object identifiers. The method also includes dynamically assigning traffic object weights to the traffic objects based on pre-established traffic criteria. Each traffic object is assigned a respective traffic object weight of the dynamically assigned traffic object weights. The pre-established traffic criteria each includes at least one weight value. The traffic object weight assigned to a traffic object of the traffic objects is based on the weight values of a set of traffic criteria, of the pre-established traffic criteria, applicable to the traffic object and reflects a level of prioritization of a right-of-way of the traffic object. The method further includes controlling flow of the traffic in the area. The controlling the flow includes controlling at least one traffic control signal based at least in part on the dynamically assigned traffic object weights.

Additional features and advantages are realized through the concepts described herein.

BRIEF DESCRIPTION OF THE DRAWINGS

Aspects described herein are particularly pointed out and distinctly claimed as examples in the claims at the conclusion of the specification. The foregoing and other objects, features, and advantages of the invention are apparent from the following detailed description taken in conjunction with the accompanying drawings in which:

FIG. 1 depicts example pre-established traffic criteria, in accordance with aspects described herein;

DETAILED DESCRIPTION

Figure 2:
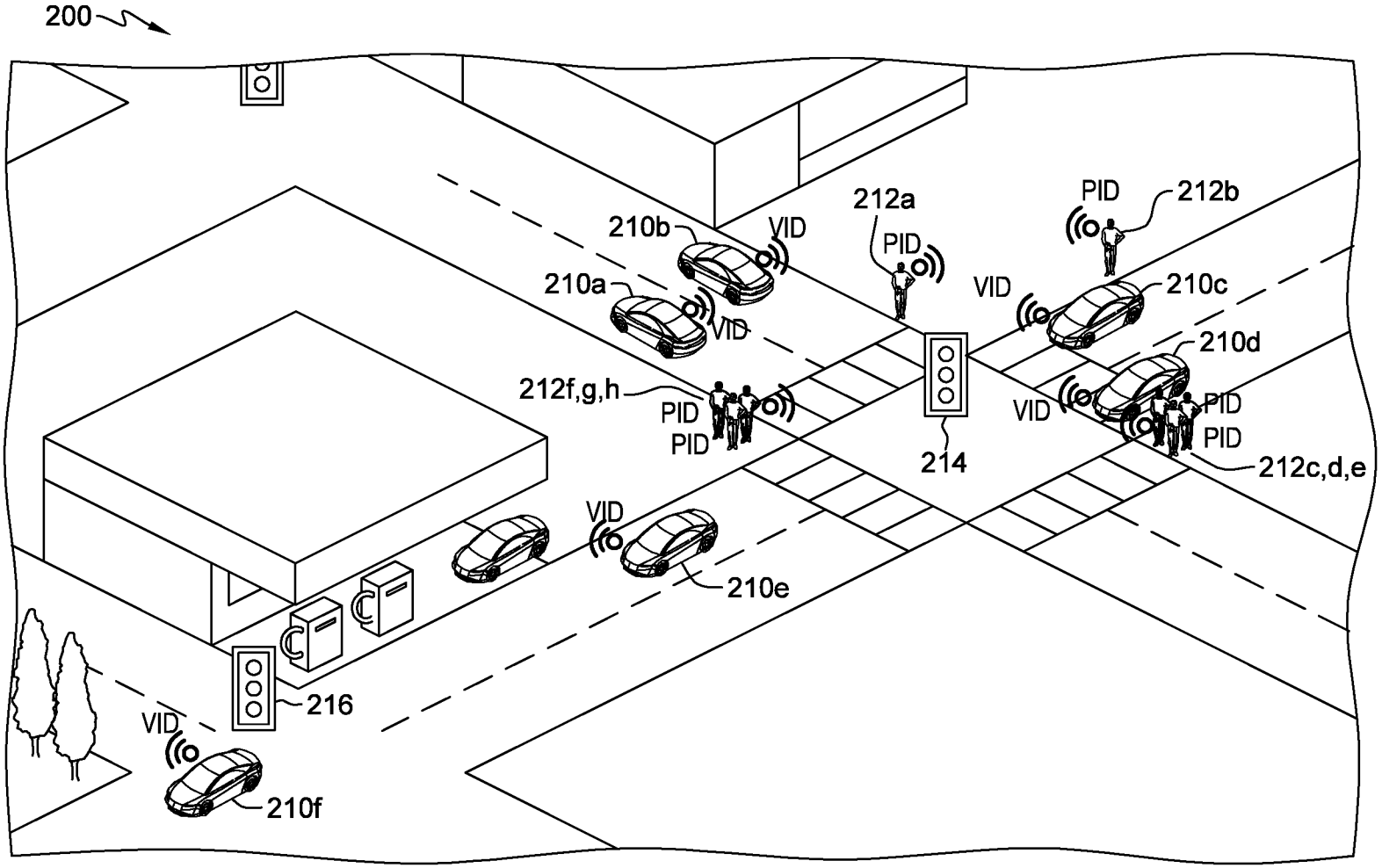
FIG. 2 depicts an example environment to incorporate and use aspects described herein.

Described herein are facilities for traffic flow control based on dynamically assigned traffic object weights. As part of this, traffic control systems can be synchronized to reduced traffic congestion and provide a more efficient overall routing of traffic by making real-time traffic signal (e.g. traffic light or other traffic control signal) decisions based on weights of traffic objects traveling through an area. Some aspects may obtain information from Global Positioning System (GPS) servers, such as servers supporting traffic software "apps", including navigation apps and other programs that keep traffic information and/or reports online. Such apps may push routes to users. Traffic signals may be in communication with each other, perhaps through a traffic server system, to share information that may be used to define an optimum traffic light control strategy to implement for a given intersection. This may be done by analyzing 'big data' from one or, more likely, many sources (obtaining traffic information/analyzing big data gathered from many endpoints, such as individual computer systems of the traffic object for which movement is being controlled). In this regard, traffic objects are each associated with a computer system, such as a smartphone or other mobile device or one built into the vehicle. As described herein, the traffic objects send information such as a unique traffic object identifier to be analyzed, and each traffic object can receive information back in the form of an update traffic object weight assigned to the traffic object. Traffic signals can make real-time decisions determining which roads are more crowded, which directions and/or traffic objects should be given a priority pass, referring to, e.g., an extended green light timeframe to address traffic congestion and/or to assist vehicles in efficiently moving from point A to point B. A priority pass can also refer to a priority road for a particular traffic object type (pedestrian, small car, truck, bus, etc.). Traffic flow can be synchronized among consecutive traffic signals along a route to provide for more fluid traffic on priority roadways.

To facilitate the synchronization, the following may be performed:

Determine real-time traffic information provider(s): There are systems and facilities that can provide real-time traffic information.

Generate a traffic strategy to reduce traffic congestion and/or delay: A real-time information provider or other analytics system, such as the IBM Watson system developed by International Business Machines Corporation, Armonk, N.Y., U.S.A. (of which IBM Watson is a trademark), can generate a traffic strategy based on the following aspects, for instance, for each traffic light or route:

i. Which roads or routes need priority pass;

ii. Location of issues or events that might affect traffic flow (accident, public protest, strike, entertainment event, road work, etc.);

iii. Which roads, routes, and traffic lights are affected by such events;

iv. Frequency of pedestrians requesting a right-of-way from a traffic light, how many pedestrians are located at the intersection, and timeframe of pedestrian usage of the traffic light;

v. Length of time usually needed for a given crowded road to normalize when there is a route priority passed;

vi. Indications from sensors or other traffic information providers about the status of traffic in the area at a given time (number of vehicles, etc.);

vii. Pattern exhibited at the intersections in a past timeframe (days, month, cycles of the year, etc.)—Trends can help inform/predict traffic patterns, which can then be validated/verified once a substantial enough amount of data (e.g. for the day of another timeframe) has been obtained. For instance, if the previous day saw many pedestrians at a particular intersection, the system might assume that a similar pattern will be exhibited on the current day. But if the data indicating traffic object presence and volume, as an examples, being collected on the current day reveals a different presence/volume of traffic, the system can correct the anticipated pattern for the current day; and viii. Similar to (vii), indications of trends, seasonality, or patterns that can be used as a base for the anticipated roadway usage based on activities nearby athletic events, concerts, etc.

Synchronize traffic light based on the generated traffic strategy—the traffic signals can be internet-connected so that a traffic server system can send directives to the traffic signals. Network connectivity to a backend traffic server system enables traffic planners to modify traffic criteria and/or weighting of the traffic objects and inform the traffic objects and/or traffic signals of these dynamic modifications. The presence of construction on a roadway might cause the system to downgrade the roadway from a highway to a local road because the speed limit has been reduced. In this case, the traffic pattern that the traffic light actually works under can be changed automatically and provided to the traffic signal by the server. More generally, the connectivity of the traffic control signals enables changes to be made in how the traffic signal works to control traffic.

In an example, real-time traffic information and big data is read and a loop determines when the information indicates a significant change in a traffic situation. Upon such changes, maps of the relevant area may be analyzed, together with any required priority passes for the roadways, to produce a strategy to reduce traffic congestion and/or delays for the road(s) that are affected by the change in the traffic situation. The strategy could include synchronizing traffic signals in terms of their strategy for cooperatively controlling movement of traffic objects along a given route. For example, a traffic server system might indicate a particular route is to have a priority pass. The traffic lights at intersections along that route can then coordinate a similar right-of-way schedule (phase shifted so that the traffic can move freely through the intersections) to allow an efficient pass for objects traveling along that route. The duration of green lights, as an example, can be synchronized for a determined timeframe (which could vary depending on the particular circumstances and state of the situation).

In accordance with further aspects, systems and methods optimize traffic flow for traffic objects, which include pedestrians and vehicles, as examples. Traffic object weights or ratings (collectively referred to herein as traffic object weights) can be assigned to the traffic objects by analyzing pre-established traffic criteria. These criteria can change depending on, e.g., government needs or special conditions for each location, area, or jurisdiction, and this information can be assigned in a traffic server system by a 'traffic planner'. A traffic planner implements some level of authoritative control over the weights assigned to the traffic objects in that the traffic planner can set the criteria weight values used to determine those weights. Examples of traffic planners include municipalities, governments, or other jurisdiction entities, regulatory authorities like a state's Department of Motor Vehicles, a city or geographic planning commission, or private organizations, such as ones receiving directives from any of the foregoing. A traffic planner, perhaps based on analytics, can configure a system to ensure that each road is tagged with the correct information and each traffic signal understands those tags. If a roadway has a bus-only lane, a traffic server system should have knowledge of this and, when appropriate, give busses in that lane a particular level of priority, and give an unauthorized traffic object such as a car that travels in that late an infraction and/or reduction in the car's weight for using a lane, which is not assigned to non-bus traffic.

Each traffic object is identified by a unique traffic object identifier. Example such identifiers are abbreviated VID for a traffic object identifier of a vehicle-type traffic object, and PID for a traffic object that is a pedestrian (other types of traffic objects are possible). The identifier enables each user (e.g. traffic object or user/person associated therewith), to be uniquely identified. A traffic object weight is assigned to a traffic object by associating the weight with the traffic object identifier of that object. The presence of the traffic objects in an area, such as those objects proximate an intersection, can be identified using radio-frequency identification, GPS, near-field communication, or any other desired facility. In some examples, the traffic object carries a physical object such as a card or a computer system that is detected to determine the traffic object's presence, direction of travel, and/or location. Example processes described herein specify:

How the weighting is performed;

How this weighting can be used to restrict travel to particular areas; and

How to control traffic flow and prioritize traffic objects for certain routes based on their weight.

Aspects described herein can provide a system including:

a database or other repository of pre-established traffic criteria and other characteristics about the environment in which the traffic objects travel;

a traffic server system;

means to sense presence of traffic objects, for instance NFC or RFID readers that may be installed at or near intersections;

traffic object records and weights for the traffic objects—these may be stored locally on computer systems associated with the traffic objects, though the weights may ultimately be controlled on the backend by the traffic server system, which can also receive additional information such as information about traffic infractions ("on Main Street, approximately every 20th car runs a particular red light" gives useful information back to the traffic server system and/or the planners to encourage police to patrol that area). Records of the traffic objects, pedestrians, traffic object behavior, timeframes, and other information may be logged at the traffic server and factor into weighting and/or decision-making regarding traffic flow control;

means to dynamically assign/update the traffic object weights; and means to assign priority and/or restrictions over routes to traffic object weights.

Accordingly, an integral solution is provided for traffic flow control for traffic objects including vehicles and pedestrians. Traffic rule compliance may also be assisted due to the monitoring that occurs and potential for making traffic control decisions that negatively affect traffic objects engaging in traffic infractions. Aspects also provide route optimization for traffic objects based on traffic object characteristics, represented as a weight, and dynamic calculation and assignment of traffic object weight, enabling proper control over the traffic in real-time.

By way of specific example: Restricted areas for a particular traffic object, e.g. a vehicle, can be determined based on traffic object weight of the object. Vehicles that are eighteen-wheelers may be assigned a relatively low weight with respect to traveling on a narrow street. The system, when assigning the weight to the eighteen wheeler, determines the weight based on appropriate individual criteria applicable to the object, area in which the object travels, environmental factors, and so on. If the characteristic of the roadway is that it is narrow, this characteristic may cause the traffic object weight of the eighteen-wheeler to depreciate with respect to using the narrow roadway. The eighteen-wheeler may instead be encouraged to use a more suitable route. In some examples, the eighteen-wheeler is discouraged from using the narrow road by deprioritizing or even preventing the eighteen-wheeler's right-of-way to enter or continue on the narrow road. This can be accomplished by the traffic control signal(s) giving relatively low priority, and therefore statistically fewer or shorter rights-of-way to the eighteen-wheeler's attempts to continue along the narrow road.

By way of another specific example: When a significant event occurs such that a relatively large number of pedestrians are walking on the streets, the system can 'create' a temporary pedestrian boulevard by assigning a high weight to the pedestrians in the area and redirecting non-pedestrian traffic by assigning a high weight with respect parallel roadways.

As yet another example, when a particular traffic object is identified frequently violating traffic control laws, the traffic object's priority (represented by the traffic object weight) is decreased, meaning it can be penalized by redirecting it to low priority streets.

As noted, aspects described herein assign weights to traffic objects by analyzing pre-established traffic criteria. FIG. 1 depicts example pre-established traffic criteria, in accordance with aspects described herein. FIG. 1 presents a table 100 housing the pre-established criteria, which each include weight values applicable to different traffic object types. Pre-established traffic criteria 102 include Weather, Road Type, Vehicle Type, Priority, and Infractions. Each is represented by a variable name 104. Criteria 102 may be broken into respective categories 106. For instance, the Road Type criteria indicates Road Type categories including highways, primary roads, and secondary roads. Each criterion also includes respective weight values for different types of traffic objects, and for each category of the criterion if applicable. In this example, weight values 108 are defined for pedestrian traffic objects and weight values 110 are defined for the vehicle traffic objects.

The pre-defined criteria and weight values associated therewith can change depending on, e.g., government needs or special conditions for different locations. In some examples, the pre-established traffic criteria are set initially and updated by a traffic planner.

In examples described herein, three are two traffic object identifier types, Vehicle ID (VID) and Pedestrian ID (PID), though it is understood that other identifier types may be used for other types of traffic objects. Each user is identified by a unique identifier and is dynamically assigned at least one weight or rating, which as described herein may be a sum of the weight values form criteria applicable to the traffic object.

FIG. 2 depicts an example environment to incorporate and use aspects described herein. It depicts an example scenario in which vehicle and pedestrian traffic objects with assigned weights interact at an intersection. The weight assigned to each traffic object (associated with the object's identifier) is used in the evaluation by the traffic light of the right-of-way priorities.

Environment 200 of FIG. 2 includes vehicle traffic objects (VIDs) 210*a*-210*f* and pedestrian traffic objects (PIDs) 212*a*-212*h*. The presence of these traffic objects is sensed by sensors installed at or proximate the intersection, for instance in traffic lights 214, 216. Such sensors may be installed elsewhere, such as in municipal lighting fixtures, or dedicated sensor stations along the roadways. They can sense approaching traffic object and deliver the identifier and weights of those object to the traffic signal for processing.

Two intersections are depicted in FIG. 2. Traffic signals 214, 216 control movement of traffic objects through respective first and second intersections, and may communicate with each other, for instance either directly or through one or more other devices such as a server with which each is in communication. In the example of FIG. 2, traffic light 214 can communicate the number of vehicles that just passed through the first intersection in a direction down the roadway toward traffic light 216. Traffic light 216 thereby obtains information in advance of the arrival of the traffic objects passing through the first intersection toward the second intersection. As these objects approach the second intersection, traffic light 216 obtains the identifiers and the associated assigned weights of those objects. In some examples, this information is obtained directly from the object themselves, for instance by computer system(s) of the traffic objects communicating the information to the traffic light. In this example, traffic light 216 (by way of a computer system, such as a computer system of traffic light 216 or a controller controlling the traffic light) re-evaluates the presence and weight assigned to every approaching vehicle. It may be that a vehicle that recently traversed the first intersection stopped at gas station on its way to the second intersection. Traffic light 214 can send an indication of the number of objects passing through the first intersection to traffic light 216 for traffic light 216 to plan for the arrival of these objects (or at least a substantial portion of them) and pre-plan a traffic control strategy based on what is expected and likely to arrive. However, traffic light 216 can obtain its own indication of the actual traffic objects approaching the second intersection as they approach, and may re-evaluate or tweak any pre-planned strategy depending on the updated indication of what specific traffic objects will imminently arrive.

Information sharing between traffic control signals 214 and 216 can include any kind of information sharing, such as volume of traffic, a number of vehicles, weights of the vehicles, indicated priority vehicles, such as emergency vehicles, or any other information that traffic light 216 might would find useful. Traffic light 214 might notify traffic light 216 of an ambulance or other emergency vehicle approaching traffic light 216. Traffic light 216 can take proper action to yield the right-of-way for the emergency vehicle, for instance by keeping the light green in the direction from which the ambulance approaches, directing traffic already at the intersection out of the way of the ambulance, and/or otherwise reducing the wait time for the ambulance. An additional example of this information includes sharing indications of an infraction, for instance the running of a red light 214 by a traffic object heading in the direction of traffic light 216. The traffic light 214 might send an indication of this to traffic light 216 to deprioritize the traffic object. Additionally or alternatively, as described herein, this information may be shared with a backend traffic server system that is responsible for assigning (and therefore decreasing) the weight of that traffic object.

As noted, a computer system in, of, or otherwise associated with a traffic object, such as an on-board computer of a vehicle or a mobile device of a pedestrian, communicates with sensors or other equipment when the object travels in order to convey the traffic object's weight and identifier to the traffic signals it encounters. In this regard, provision of the weight and traffic object identifier to the traffic control signals may be offloaded to the traffic objects, which store their weight. The traffic object can receive its dynamically assigned weight, e.g. from a traffic server system, and present that weight to a local traffic control signal when the traffic object approaches an intersection controlled by that traffic control signal. The traffic control signal receives that and identifies that "traffic object with identifier X has a weight of Y". It can also identify that a prior traffic light that this traffic object passed sent an indication to the traffic control signal object that the traffic object just ran its red light. The traffic control signal can, as the traffic object approaches, assign an infraction to the traffic object and lower its priority. Additionally or alternatively, the prior traffic light can recognize the infraction and send an indication of this to the traffic server system to cause the server to reduce the weight of the traffic object. Then at the traffic control signal and potentially others for an amount of time or travel distance, that traffic object may receive statistically more red lights than other traffic object that did not perpetrate traffic infractions. In this manner, the traffic object is penalized for running the red light.

The traffic objects can receive their weight from the traffic server either directly from the traffic server or indirectly via a traffic control signal. In some embodiments, the weight of a traffic object is re-calculated and assigned, e.g. by the server, frequently, such as every time or most times after the traffic object passes through or by an intersection.

An understanding of an environment in later portions of the routes of traffic objects is evaluated when the traffic objects arrive at an intersection. In cases of a weather event such as a snowstorm, priority in terms of right-of-way may be given to objects turning left (away from the snowstorm) while a lower priority may be given to objects going straight (toward the snowstorm). Additionally or alternatively, this prioritization may hold true for some traffic objects but not others, for instance trucks, where a snowstorm may not be a significant event for a truck and it may generally not be advisable to alter the truck's selected route for such an insignificant event.

Processing to determine priorities for the different directions through the intersection (e.g. which direction is to have the green light at any given time) could be performed locally, for instance by the traffic control signal or a computer system associated therewith, remotely, for instance by a cloud-based facility such as a traffic server system, or a combination of the two. In any case, it may be desired for each traffic control signal to have an ability to work in a standalone manner to control the intersection, in case communication between the traffic control signal and a backend system such as a cloud facility/traffic server is broken. Thus, a traffic control signal may always have at its disposal certain processing power to perform offline traffic flow strategizing and control based on received traffic object information such as identifiers and weights received from the traffic objects.

Figure 3:
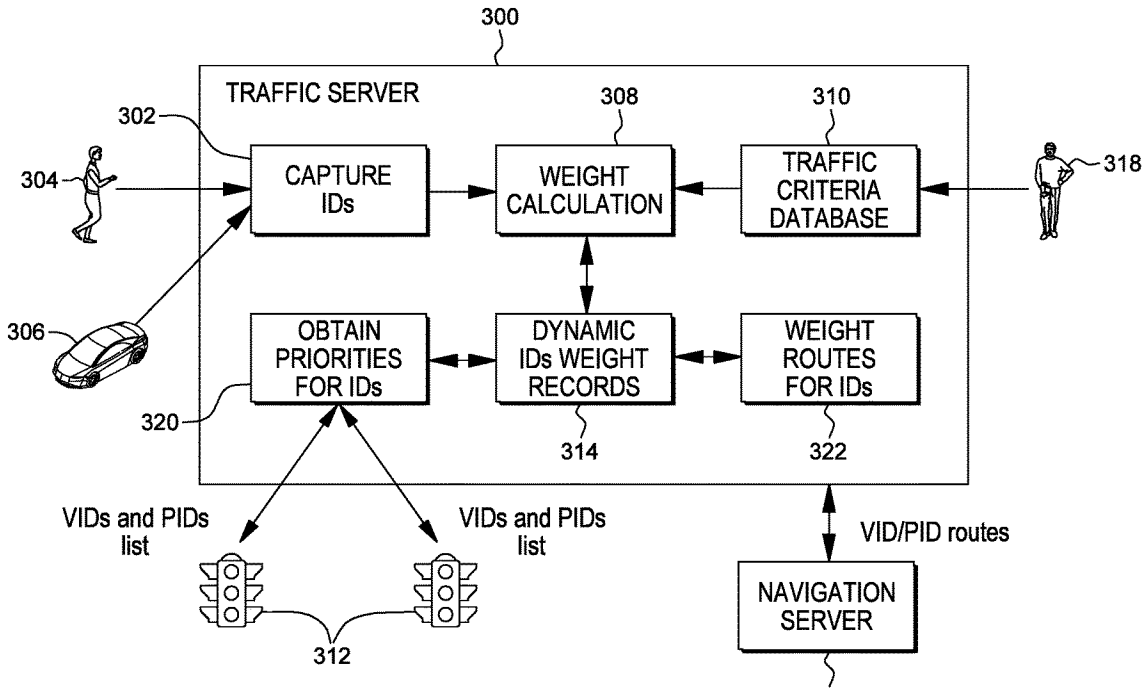
FIG. 3 depicts an example embodiment of a traffic server system and communication therewith, in accordance with aspects described herein.

FIG. 3 depicts an example embodiment of a traffic server system and communication therewith, in accordance with aspects described herein. Traffic server system 300 includes different components, which in this example are integrated but in other embodiments may be separate and span multiple systems that may or may not be co-located. The traffic server system can be implemented as one or more computer systems.

Service 302 is a server to capture traffic object identifiers, e.g. from pedestrians 304 and vehicles 306 (a computer system of or associated therewith). The system 300 can continuously or periodically receive data from sensors regarding the identified identifiers (IDs), for instance location of each object. In some examples, the traffic control signals capture the IDs, though in other examples a light control box or lamppost closest to the light, as examples, may capture these IDs. In a particular embodiment, sensor(s) sit along a route before the intersection in order to give some time for the traffic control signal or other system to perform calculations between sensing the approaching traffic object and its arrival to the intersection. The ID and weight information is provided to the control signals to be used in an evaluation of how to control traffic through the intersection, for instance to determine whether/when the light should give right-of-way. Meanwhile the weighting of an object may change based on backend calculations by a weight calculation process 308 based on the data that is available and the traffic criteria database 310, which might house pre-established criteria.

Traffic lights 312 may be an interface point that obtains vehicle and pedestrian information gathered from, as an example, another traffic light. In this example, the traffic lights 312 are in communication with system 300 on the backend that has the dynamic IDs weight records 314. Lists of traffic objects passing through one intersection toward another may be provided from one traffic light to another, for instance so that the other traffic light can begin traffic flow control planning based on anticipated traffic approaching the other traffic light.

Additionally, information from navigation server(s) 316 is also provided to traffic server 300 in this example. This information can include route information for traffic object(s) that the navigation servers are guiding. Knowledge of the routes that the traffic objects are taking can assist prioritizing the rights-of-way for the involved traffic objects. In some example, the navigation servers are remote serves supporting navigation applications such as Waze offered by Google Inc., Mountain View, Calif., U.S.A. (of which WAZE is a trademark). Navigation server(s) 316 can also include servers that provide real-time or near real-time traffic updates, providing indications of traffic congestion or slowness, hazards, delays, etc. on a given road ahead. This information may be sent back to the traffic lights for potentially deprioritizing traffic flow toward these problem areas.

Weight routes for IDs 322 refers to weights for particular routes that may be followed by traffic objects. The weights may correspond to different traffic object types. Based on categories, a traffic planner may be able to determine which routes should be used by different types of vehicles, perhaps given certain circumstances. For example, trucks can be prioritized on routes relatively far from a downtown area where streets may be more crowded and less maneuverable by large vehicles, while small vehicles may be prioritized on central avenues and streets instead of being routed along a longer, less direct route. The system can indicate through the weight routes for IDs module 322 which route, on a provided set of routes, is better for a traffic object according to its weight.

Traffic criteria database 310 stores the criteria available for weighting by route and the respective weight values assigned by a traffic planner 318. The traffic planner(s) can interface with the traffic criteria database (which might encompass a separate database server to which the database is associated). This is where the traffic planner can indicate not only weight values, but the criteria and/or the categories. Additional information such as indications of roadwork or tendency for particular bridges to ice over during cold rainy weather can also be indicated in the traffic criteria database.

The weight calculation process 308 uses the IDs data (captured by 302), environmental data (weather conditions, construction notices, etc.), and traffic criteria data from traffic criteria database 310 to establish traffic object weights and store them to the Dynamic IDs weight records database 314 (refer to determining priority by adding multiples weights or ratings below). In a particular example, the dynamic IDs weight records database 314 stores data for traffic objects' current and historic weights.

Traffic lights 312 provide the list of PIDs, VIDs that traverse though the intersection that they respective control. This may be provided back to the weight records database 314 directly or through the obtain priorities for IDs module 320. Thus the traffic lights can provide the information that they gather of vehicles going through their intersections. In some examples this is provided to and evaluated by another traffic light or something else through the dynamic ID weight records 314. This may be used to adjust/rewrite a weight of a traffic object.

As explained in detail below, a sum of all of the total weights of the traffic objects that head in a common direction or path through the intersection can be evaluated against a sum of all traffic objects that desire to cross the intersection in one or more other directions. The evaluation can be performed by a traffic control signal for the intersection or by the traffic server and sent back to the traffic control signal to dictate control, such as 'stay green for 10 more seconds' or 'switch to red and give priority to a next direction'.

A traffic light can obtain an indication about approaching traffic objects, e.g. in the form of a list from another traffic light. The traffic light can also utilize sensors installed near the light that detect the actual traffic arriving at the intersection. As noted above, the traffic light can use the provided list of anticipated arriving traffic objects to begin calculations to determine traffic control. For instance, it may use it for more generalized determinations, such as to evaluate applicability of traffic patterns from previous days. It may determine based on the anticipated arriving traffic that that amount of traffic would suggest remaining on green for 20 seconds longer than it did the day before. This could be a planned traffic control strategy subject to tweaking or modification based on sensing what traffic objects actually arrive when they arrive. In the event of a relatively small deviation between the prior-supplied list of traffic objects anticipated to arrive and the actual traffic objects that arrived (perhaps a few traffic objects turned onto a side road), there may be little or no deviation from the planned strategy. If there is a major deviation, for example an accident occurred involving the anticipated traffic objects such that very few of them actually arrived at the intersection, the planned strategy may be more aggressively tweaked.

Accordingly, several approached are provided herein and described as follows.

Determining priority by adding multiples weights or ratings:

Traffic object identifiers can be linked into a Dynamic IDs weight records database (e.g. 314 of FIG. 3) that is kept up to date in terms of traffic object weight using real-time information about the traffic object (location, planned route, infractions, etc.). This traffic criteria database (e.g. 310 of FIG. 3) can include criteria representing variables defined and tailored by a traffic planner. The criteria have respective weight values, which apply to one or more types of traffic objects, such as a weight value for each of PID and VID. Different traffic object types and even categories within a given criterion may have different weight values.

The traffic server, a traffic control signal, or a combination of the two can gather and add all weights for each PID and VID of a collection of traffic objects, for instance those that desire to traverse an intersection in a common direction.

Also, in some examples the pedestrian identifier of a pedestrian entering a vehicle can be linked to the VID of the vehicle, which could cause the system to assign an increased weight of the vehicle. If this option is available for vehicles, it may be desired that the traffic planner consider adding a higher-level criteria for those roads where pedestrians must have priority pass.

Referring back to FIG. 1, for each traffic object type (e.g. pedestrian and vehicle here) and for each category of a given criteria there is defined a single weight value in the table. The traffic server, in determining and assigning a weight for a particular traffic object, receives whatever data it needs about the traffic object, such as vehicle type (if applicable), priority, etc., and also receives information about the current road type that the traffic object is traversing, environmental conditions such as weather, and other information that might factor into the weight calculation. The system can sum the applicable weight values for the traffic object as indicated for all of the applicable criteria on the particular intersection in the direction the object is traveling.

As another example, if there is roadwork on a road it may not be desired to allow or at least prioritize pedestrian traffic on that road. Roadwork may represent a status of the road at that time. This status might factor into the weight calculation for a pedestrian. For instance, a criterion might be "road status" and a subcategory might be 'construction'. The weight value for the pedestrian traffic object type might be a negative number, serving to decrease the traffic object weight of the pedestrian. The pedestrian's device conveys to the traffic server that the pedestrian wants to head down that road. This may be by virtue of the pedestrian having indicated a route that the pedestrian will take (e.g. via a navigation application that is sharing the route with the traffic server) or by virtue of the pedestrian arriving at an intersection and a traffic control signal learning that the pedestrian desires to head down that road based on the lane in which the object is positioned, as examples. When this happens, the traffic server, in one embodiment, can cause the traffic control signal to signal a red light, no crossing, etc. signal to the pedestrian in an attempt to prevent the pedestrian from heading in that direction. In a particular embodiment, the server calculates the pedestrian's weight with respect to that direction, returns that to the pedestrian's device, which conveys the weight to the traffic light, and the traffic light behaves accordingly by holding the red against the pedestrian.

Indications of roadway statuses like construction, potholes, icy conditions, etc. can be manually entered into the system or automatically identified in the system, for instance based on the system parsing available information online like weather conditions or road closures.

Continuing with the pedestrian example above, a status of the pedestrian, such as the pedestrian being a police officer, might trump the red light otherwise given to the pedestrian, on the basis that police officer might be involved in a situation that warrants him or her entering the road with roadwork. In some embodiments, police, medical, fire, and other emergency personnel can set a current status indicative of whether they are currently involved in an emergency situation that warrants prioritizing their intended route over alternative route(s) and/or over nearby traffic objects.

A weight for a traffic object is obtained, in some examples, by adding all of the criteria assigned or applicable to the traffic object. As an example, traffic object O, a pedestrian, desires cross main street—a secondary road—at 11:00 AM on a Monday morning, in 'good' weather, walking, and O generally does not cross against a signal. The foregoing encompasses many criteria each of which would have a respective weight value. The total weight for traffic object O is, in this example, a summation of these weight values. The weight calculation process 308 adds each of these weight values and provides that total weight back to traffic object O (e.g. a computer system of or associated with O). If several pedestrians are waiting with O to cross in the same direction, there is a similar weight calculation performed for each of them. The traffic signal could obtain the total weights of each of the pedestrians and add them to obtain a total weight of traffic objects desiring to traverse in that direction. This total weight of traffic objects can be compared against the total weight of traffic object(s) desiring to traverse in other direction(s), and that comparison can inform the sequence in which the various rights-of-way are signaled for the traffic objects at that intersection.

Figure 4:
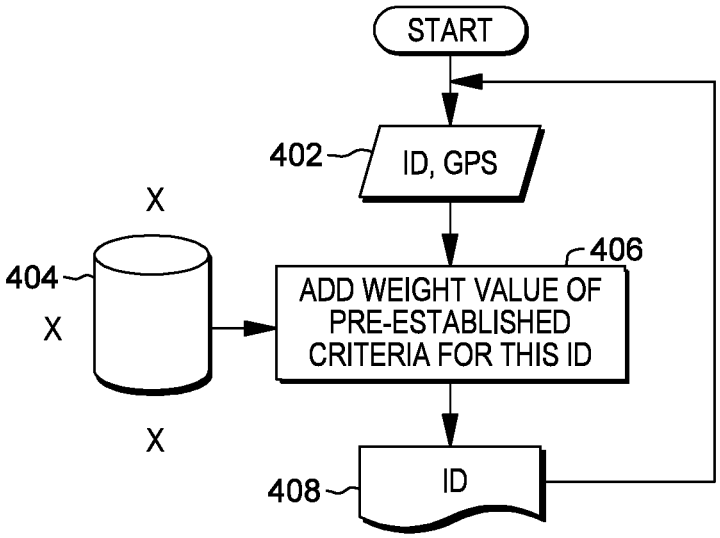
FIG. 4 depicts an example process for assigning weights to traffic objects, in accordance with aspects described herein.

FIG. 4 depicts an example process for assigning weights to traffic objects, in accordance with aspects described herein. The process obtains a next traffic object identifier and location of the traffic object (for determining the applicable roadway, weather, etc.) (402). Then, the process obtains from the traffic criteria database 404 the weight values of the pre-established criteria applicable for this traffic object and sums them (406) to obtain the total weight of the traffic object for the traffic object ID (408). As shown, the process then repeats, and this iterates for each traffic object for which a weight is to be calculated.

A detailed example of weight calculations is given as follows, given a set of criteria C={C1. C2, . . . , Cn}, set of pedestrians P={P1. P2, . . . , Pn}, and set of Vehicles V={V1. V2, . . . , Vn}:

Each vehicle has zero or more passengers (counted in this example as pedestrians)—Vehicle Vx has passenger Vx_P1, Vx_P2, . . . , Vx_Pn.

Each pedestrian Px has an associated weight value, w, for every criteria Cx. This is defined as Px_C=[{Px_C1, w}, {Px_C1, w}, . . . , {Px_Cn, w}].

Then, the total weight (TW) of Px, designated TW_Px, is the sum of its Cx weights—TW_P(Px)=TW_Px=SUM (Px_C[Px_C1], Px_C[Px_C2], . . . , Px_C[Px_Cn]).

Also, every vehicle Vx has an associated weight value, w, for every criteria Vx_Cx. This is defined as Vx_C= [{Vx_C1, w}, {Vx_C1, w}, . . . , {Vx_Cn, w}].

Then, the total weight (TW) of Vx, designated TW_Vx, is the sum of its Cx weights plus, optionally, the TW_Px of its passengers—TW_V(Vx)=TW_Vx=SUM(Vx_C[Vx_C1], Vx_C[Vx_C2], . . . , Vx_C[Vx_Cn]) [+SUM(TW_Px (Vx_P1), TW_Px(Vx_P2), . . . , TW_Px(Vx_Pn))].

Note that traffic objects can have a weight value equal to 0 for Cx that do not apply to them. For example, vehicle type is not a criterion for pedestrians, so the weight value of criterion "vehicle type" for category "pedestrian" may be 0. Alternatively, different sets of criteria can be defined for different traffic object types.

Yield Pass on Controlled Interactions:

As traffic lights are important controls in vehicles/pedestrian traffic coordination, it may be desired to define how weight is used in deciding priority through an intersection. In a particular example, the approach (i) sums the TW_P(Px) of the pedestrians waiting at a corner of an intersection and (ii) sums the TW_V(Vx) of the vehicles in the crossing roadways, in order to yield to those traffic objects (the pedestrians or the vehicles) having the greater total weight. This is described with reference to FIG. 5, which depicts an example of traffic signal operation using traffic object weights, in accordance with aspects described herein.

With respect to vehicle traffic objects (VIDs), the total weight (TVID) of vehicles traversing in one direction is based on a determination whether more than one VID is requesting to pass (502). If not, then TVID equals the total weight of the single VID (504). Otherwise, the TVID is equal to the sum of the total weight of each VID requesting to pass (506).

Similarly with respect to pedestrian traffic objects (PIDs), the total weight (TPID) of pedestrians traversing in one direction is based on a determination whether more than one PID is requesting to pass (508). If not, then TPID equals the total weight of the single PID (510). Otherwise, the TPID is equal to the sum of the total weight of each PID requesting to pass (512).

Figure 5:
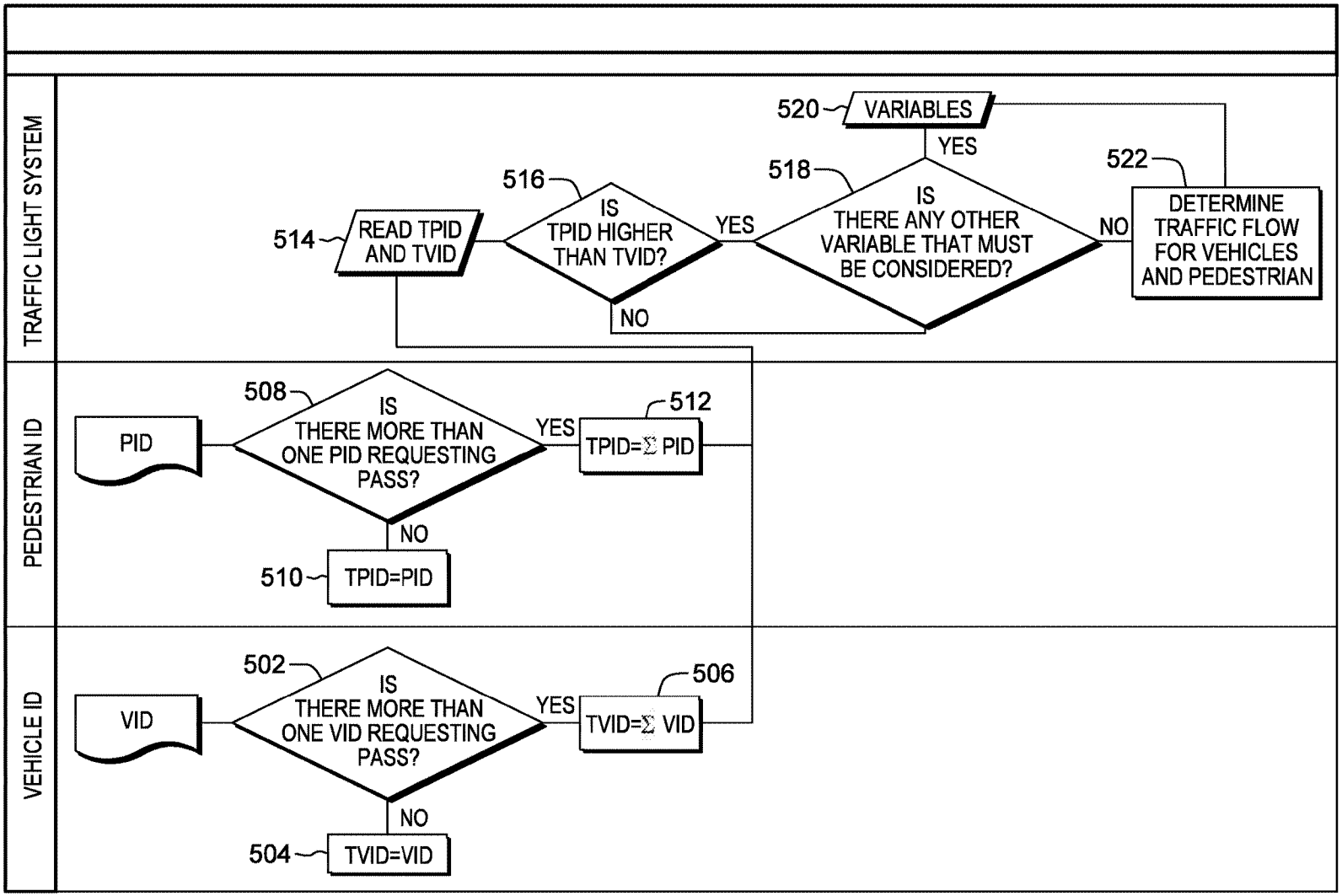
FIG. 5 depicts an example of traffic signal operation using traffic object weights, in accordance with aspects described herein.

Then, the traffic light system or component thereof, such as a traffic control signal, reads the TPID and TVID (514) and determines whether TPID is greater than TVID (516). This inquiry determines whether the total weight of the pedestrians is higher than the total weight of the vehicles. If so, the pedestrians are given the priority pass, e.g. right-of-way, unless other variables suggest otherwise. Conversely, if TPID is not greater than TVID, the vehicles are given the priority pass, e.g. right-of-way, unless other variables suggest otherwise. Thus, in any case, a determination is made as to whether there are any other variable(s) that are to be considered (518). Example such variables may be ones that are to affect not the weight of the traffic objects themselves but instead the weight of the specific intersection for use by those traffic objects. An example variable is a gas leak reported down a road in a particular direction from an intersection. It would not be desired to send pedestrians down a road with a gas leak, and this emergency is largely not a reflection on a weight of the pedestrians that they will carry around with them to other intersections (subject to modification in between if appropriate) leading to routes that are unaffected by the gas leak. An alternative would be to dynamically re-assign weights of the pedestrians based on the gas leak—either through criteria defined in the traffic server, or dynamically by the local traffic signal. Instead, the approach in FIG. 5 provides a different type of override in the form of other variables, to potentially override what the comparing 516 suggests should be the priority.

Accordingly, if there are other variables to consider (518, YES), these variables 520 are taken into account and the traffic flow for the vehicles and the pedestrians is determined accordingly (522). Otherwise, if no other variables are to be considered (518, NO), the traffic flow for the vehicles and the pedestrians is determined accordingly (522) by giving priority to the traffic objects TVID or TPID with the higher total weight.

Determining Percentage of Vehicle Allocation and Priority Pass:

This approach gives more priority to vehicles that have a higher utilization in terms of their occupancy. The percentage of vehicle allocation may be a criterion that is used in the weight determination for a traffic object. Vehicles that have a highest percentage of allocation may have the priority pass. If a vehicle with a capability of transporting 5 passengers currently transports just one passenger (the driver), the percentage of allocation is ⅕=20%. The system, by way of the criteria, could deprioritize this traffic by assigning it a low weight, potentially even denying such an underutilized vehicle the opportunity to travel on specific roads. This might put pressure on the driver to prefer a bus or carpool for an increased priority. Thus, it helps ensure that priority is given to those who are more fully utilizing vehicle capacity.

This approach can be used as a criterion for determining priority pass, or it could be added as an additional criterion, incorporated into the determination of priority by adding multiple weights above. In some examples, vehicle allocation comes into play when weights of a plurality of traffic objects are otherwise the same.

A detailed example of weight calculations is given as follows, given the above definition of total weigh of a vehicle Vx, or TW_Vx like SUM(Vx_C[Cx_V1], Vx_C [Vx_C2], . . . , Px_C[Vx_Cn]) [+SUM(TW_Px(Vx_P1), TW_Px(Vx_P2), . . . , TW_Px(Vx_Pn))].

A vehicle Vi may have priority over another vehicle Vj if TW_Vi>TW_Vj.

For these two vehicles Vi and Vj, assuming the same criteria weight for both, or SUM(Vi_C)==SUM(Vj_C), then the priority between Vi and Vj may be given by the sum of the TW_Px of its passengers:

If SUM(Vi_C)==SUM(Vj_C), then if SUM(TW_P(Vi_P1), TW_P(Vi_P2), . . . , TW_P(Vi_Pn))>SUM(TW_P(Vj_P1), TW_P(Vj_P2), . . . , TW_P(Vj_Pn)), then P=Vi, else P=Vj.

Restricting Access to Areas:

Through criteria, the traffic planner can indicate which vehicles or drivers may or may not traverse specific roads. Because heavy traffic is common in many cities around the world, this system can be configured to provide lighter traffic for specific categories or drivers.

Example Scenarios are:

Vehicles that have a rating higher than "X" can traverse Central Avenue between 7:00 AM and 7:00 PM;

During this same timeframe, vehicles of type "Bus" will have priority on 1st Avenue for busses with total weigh greater that 2000, and all other busses will have priority on 2nd Avenue.

A road that is marked as a highway will likely not have many busses. So, any roads that lead directly to onramps to the highway could have a lower priority for the buss type of vehicle. This is not to say that busses cannot use the highway or the roads leading to the highway, rather the priority could be different.

As another example, vehicles in a presidential motorcade could define the priority route (constant right-of-way based on wherever those vehicles travel). The system might allow this on the basis that the traffic signals should never fail to give the president the right-of-way when the president arrives at the intersection.

Another capability when traffic lights read the weights of approaching traffic objects is that it can identify whether a traffic object is traveling along a prohibited road, in which case the traffic light or the backend system could send a warning to a traffic officer about the traffic object's location and/or proceed to automatically penalize the traffic object, either through generation and provision of a ticked or violation, or by indicating back to the traffic server the infraction, as examples.

As also described herein, navigation applications can use criteria to determine best (highest priority) routes for their users. In this regard, the apps could be linked to the user's traffic profile indicating characteristics about the traffic object, weighting, etc. for an assessment of the object's priority along different possible routes. Referring back to FIG. 3, the navigation server 316 could interface with the dynamic IP weight records 314 holding the profile for the traffic object. The profile might indicate the object currently holds 5 passengers and is traveling from point A to point B. Meanwhile, information has been obtained from the traffic signals down that route. The system could be open to allow third-party apps to access this information including the profile and traffic signal information.

Criteria sets can be specific to a given road, street, avenue or block, with the criteria definitions favoring specific routes for specific pedestrians or vehicles.

Thus, a detailed example of route restriction is given as follows: There exists a set of possible routes R={R1, R2, . . . , Rn}, where each route has a priority criteria Rx_C. Also, each route Rx may have a configured restriction value ResV_Rx, which represents a minimum weight allowed to use the route. The priority value of a vehicle in a route Rx is its total weight for that specific route TW_V_Rx(Vx), which is calculated using the related route priority criteria Rx_C.

For a vehicle Vi, a route Rx (street, avenues) is restricted if TW_V_Rx(Vx) is lower than the configured ResV_RX.

Route Selection According to IDs Weight:

Through criteria, the traffic planner can indicate which routes should be used by different types of vehicles. For example, trucks can be prioritized on routes relatively far from downtown, while small vehicles may be prioritized on central avenues and streets. Example ways in which this could be used include: completely restricting a traffic object from using the route—indicating that a particular route is not a pedestrian route, meaning it will not send a pedestrian along the route and/or imposing a minimum weight to use the route.

The system may indicate which route, of a provided set of routes, is better for traffic object in terms of its priority, according to its weight.

A detailed example of route selection is given as follows: There exists a set of possible routes R={R1, R2, . . . , Rn}, where each route has a priority criteria Rx_C. The priority value of a vehicle in a route Rx is its total weight for that specific route TW_V_Rx(Vx), which is calculated using the related route priority criteria Rx_C.

For a vehicle Vi that requests a route to a navigation server, the result of this aspect may be a Designated Route (DR), which is the route with the highest total weight for the Vehicle Vi DR=R[HIGHEST(TW_V_R1(Vi), TW_V_R2(Vi), . . . , TW_V_Rn(Vi))].

Described herein are facilities for vehicle and non-vehicle traffic flow control based on dynamically assigned traffic object weights. Aspects described herein enable automatic coordination of actions among traffic signals along routes, for instance to optimize a flow of emergency vehicles, while minimizing traffic jams. Aspects described herein present solutions for optimized traffic control in the face of obstructions, single points of failure, atmospheric and environmental conditions, and GPS satellite availability, and so on, which might be especially useful in cities having tall buildings that can interfere with communications.

Aspects described herein can take and analyze traffic information (for vehicles and pedestrians) from different sources (cameras on the intersections, and other databases) and, based on this analysis, generate optimal routes for drivers and pedestrians by synchronizing traffic lights to new timing pattern(s) dynamically determined based on the specific traffic object weights of traffic traversing the area. A system can determine and analyze how many traffic objects of various types await traversal of an intersection in various directions and, based on this analysis, exchange data between affected traffic lights regarding when to prioritize rights-of-way for the various traffic object types. Aspects also provide for tracking traffic object progress from one traffic light to a next for accurate volume calculation.

Aspects can optimize the traffic flow for not only vehicles but also pedestrians, for instance by integrating additional data sources and time of day patterns to set traffic signal control.

Further, aspects can synchronize a grid of traffic lights, where each traffic light sends data to a next traffic light in each direction, and each traffic light is able to make decisions for optimal signaling patterns to control traffic flow, based on the data from other traffic lights in the different directions, while taking into account both vehicle and pedestrian traffic.

Figure 6A:
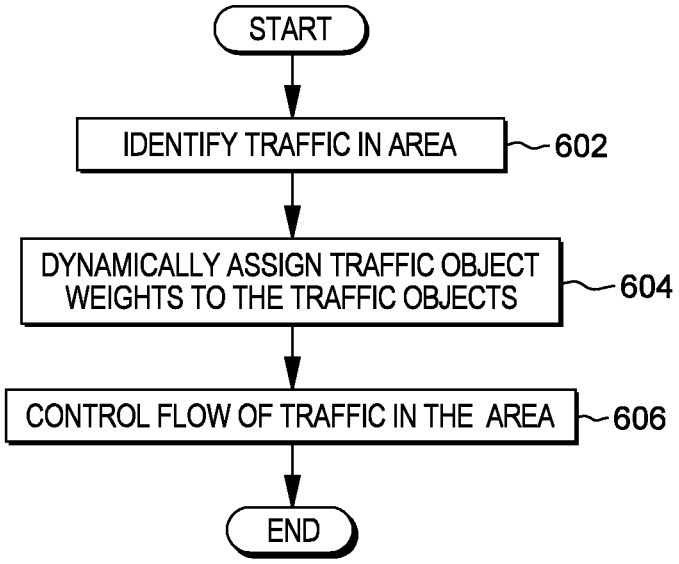
FIG. 6A depicts an example process for traffic flow control in accordance with aspects described herein.

Accordingly, processes are described herein for traffic flow control. FIG. 6A depicts an example such process for traffic flow control in accordance with aspects described herein. The process of FIG. 6A may be performed by one or more computer system(s), such as a traffic server system, traffic control signals or associated computer system(s), or a combination of the foregoing.

The process of FIG. 6A begins by identifying traffic in an area (602), the traffic including traffic objects, and the identifying including obtaining traffic object identifiers of traffic objects in the area, each traffic object of the traffic objects being identified by a respective traffic object identifier of the traffic object identifiers. The area may be a geographic area, such as an area encompassing or proximate one or more traffic-signal-controlled intersections, as an example. The traffic objects can include vehicle traffic objects and non-vehicle traffic objects.

The process continues by dynamically assigning traffic object weights to the traffic objects (604), for instance based on pre-established traffic criteria. Each traffic object may be assigned a respective traffic object weight of the dynamically assigned traffic object weights. The pre-established traffic criteria may each include at least one weight value, where the traffic object weight assigned to a traffic object of the traffic objects may be based on the weight values of a set of traffic criteria, of the pre-established traffic criteria, applicable to the traffic object and reflect a level of prioritization of a right-of-way of the traffic object.

The process then continues by controlling flow of the traffic in the area (606). The controlling the flow can include controlling at least one traffic control signal based at least in part on the dynamically assigned traffic object weights. The controlling can prioritize right-of-way of the vehicle traffic objects and of the non-vehicle traffic objects relative to each other.

In some examples, a process further includes receiving a list of traffic object identifiers of traffic objects proceeding through the intersection in a direction away from the intersection, and providing an indication of the traffic objects and traffic object weights of the traffic objects to at least one other traffic control signal of another intersection to which the traffic objects are proceeding, to facilitate pre-planning of traffic control by the at least one other traffic control signal in controlling flow of the traffic objects through the another intersection.

Obtaining the traffic object identifiers can include using one or more sensors positioned proximate an intersection in the area to detect the traffic object identifiers as the traffic objects approach the intersection. The dynamically assigned traffic object weights of the traffic objects may be obtained together with the traffic object identifiers as the traffic objects approach the intersection.

Figure 6B:
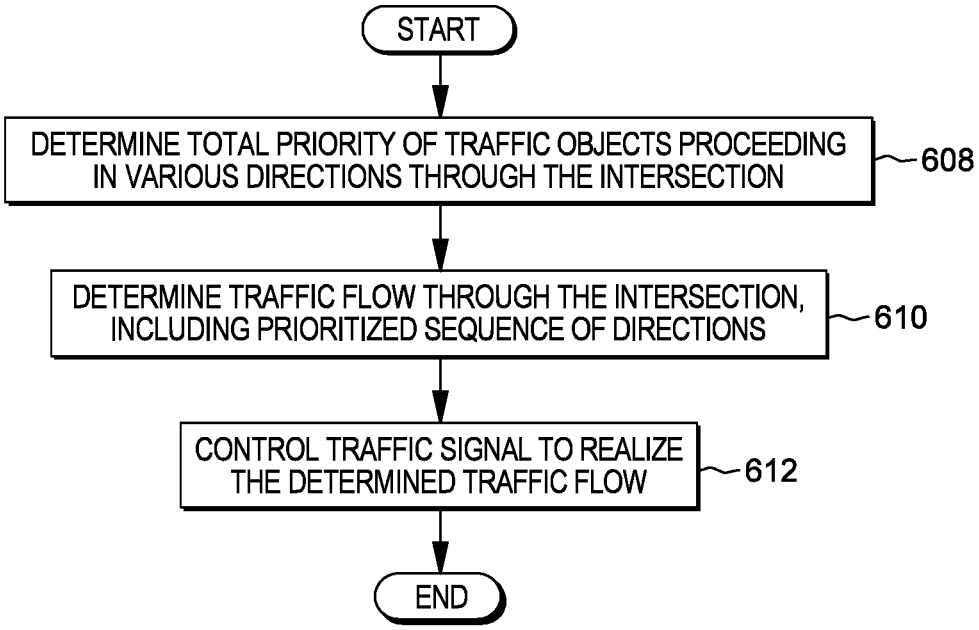
FIG. 6B-6C depict example processes for traffic signal control for controlling traffic through an intersection, in accordance with aspects described herein.
Figure 6C:
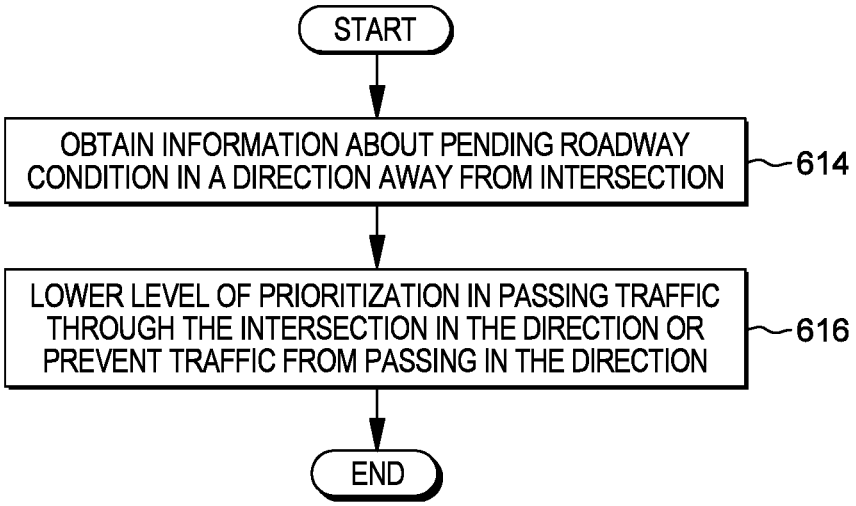

The controlling the flow of the traffic can control the at least one traffic control signal to control the movement of the traffic objects through the intersection. FIG. 6B-6C depict example processes for traffic signal control for controlling traffic through an intersection, in accordance with aspects described herein.

Referring to FIG. 6B, the process determines, for each direction of at least two directions through the intersection controlled by the at least one traffic signal, a total priority of traffic objects proceeding in the respective direction, based on the dynamically assigned traffic object weights of traffic objects proceeding in that direction (608). The process also determines, based on the obtained total priorities of traffic objects proceeding in the at least two directions, a traffic flow through the intersection, the traffic flow including a sequence of the at least two directions prioritized by total priority of traffic objects proceeding in each direction (610). The process then controls the traffic signal to realize the determined traffic flow, where right-of-way through the intersection proceeds through the prioritized sequence of the at least two directions.

Referring to FIG. 6C, another example of traffic signal control for controlling traffic through an intersection, the process includes obtaining information about a pending roadway condition of a roadway in a direction away from the intersection (614). The controlling may be further based on the information about the pending roadway condition, wherein the controlling lowers a level of prioritization in passing traffic through the intersection in the direction or prevents traffic from passing through the intersection in the direction (616).

In some examples, a process (such as a process of FIG. 6A) further includes monitoring the traffic object passing through a first intersection in the area, identifying an infraction committed by the traffic object, and modifying the traffic object weight assigned to the traffic object based on the infraction. The modifying can decrease the level of prioritization of the right-of-way of the traffic object.

In a particular example, a traffic object of the traffic objects includes a motorized vehicle with one or more passengers, and the process further includes dynamically assigning a weight to each passenger of the one or more passengers based on the pre-established traffic criteria, where the traffic object weight of the motorized vehicle is based further on the dynamically assigned weight of each passenger of the one or more passengers.

Additionally or alternatively, a traffic object of the traffic objects can include a motorized vehicle with a number of passengers, where the traffic object weight of the motorized vehicle is based further on a function of the number of passengers of the motorized vehicle and a number of passengers the motorized vehicle is equipped to accommodate, where a lower number of passengers results in a lower traffic object weight.

A process (such as a process of FIG. 6A) can further include configuring priority parameters of a roadway or route in the area to deprioritize use of the roadway or route by traffic objects subject to the priority parameters.

Figure 7:
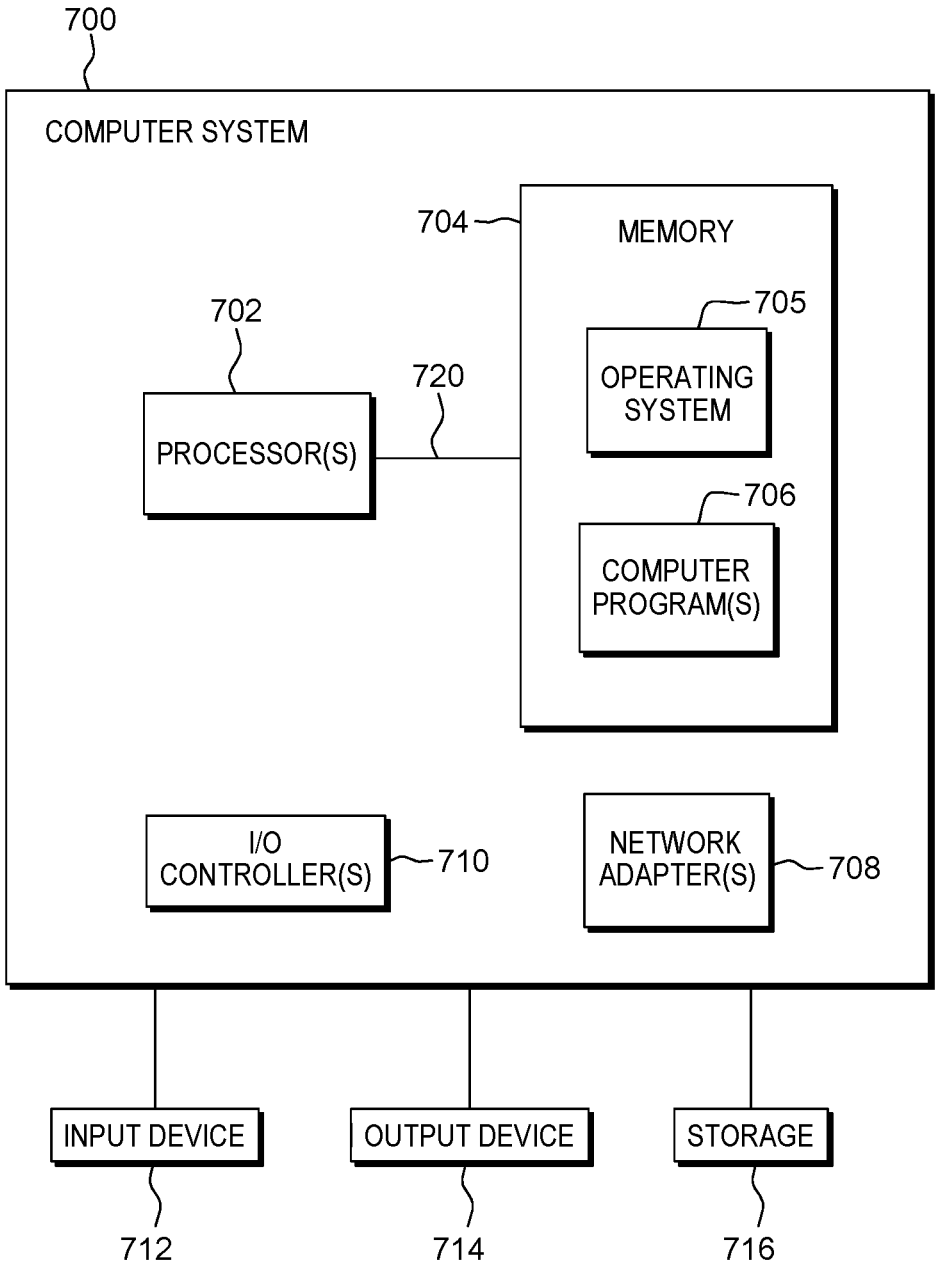
FIG. 7 depicts an example of a computer system to incorporate or use aspects described herein.

Processes described herein may be performed singly or collectively by one or more computer systems, such as computer system(s) described below with reference to FIG. 7. FIG. 7 depicts one example of a computer system to incorporate or use aspects described herein. A computer system may also be referred to herein as a data processing device/system or computing device/system, or simply a computer. Computer system 700 may be based on one or more of various system architectures such as those offered by International Business Machines Corporation (Armonk, N.Y., USA), Intel Corporation (Santa Clara, Calif., USA), or ARM Holdings plc (Cambridge, England, United Kingdom), as examples. In some example, a traffic control signal is or comprises a computer system.

Computer system 700 is suitable for storing and/or executing program code and includes at least one processor 702 coupled directly or indirectly to memory 704 through, e.g., a system bus 720. In operation, processor(s) 702 obtain from memory 704 one or more instructions for execution by the processors. Memory 704 may include local memory employed during actual execution of the program code, bulk storage, and cache memories which provide temporary storage of at least some program code in order to reduce the number of times code must be retrieved from bulk storage during program code execution. A non-limiting list of examples of memory 704 includes a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. Memory 704 includes an operating system 705 and one or more computer programs 706, for instance programs that can execute to perform aspects described herein, such as those described with reference to FIGS. 4, 5 and 6A-6C, as examples.

Input/Output (I/O) devices 712, 714 (including but not limited to displays, microphones, speakers, accelerometers, gyroscopes, magnetometers, light sensors, proximity sensors, GPS devices, cameras, etc.) may be coupled to the system either directly or through I/O controllers 710.

Network adapter(s) 708 may also be coupled to the system to enable the computer system to become coupled to other computer systems, storage devices, or the like through intervening private or public networks. Ethernet-based (such as Wi-Fi) interfaces and Bluetooth® adapters are just examples of the currently available types of network adapters 708 used in computer systems.

Computer system 700 may be coupled to storage 716 (e.g., a non-volatile storage area, such as magnetic disk drives, optical disk drives, a tape drive, etc.), having one or more databases. Storage 716 may include an internal storage device or an attached or network accessible storage. Computer programs in storage 716 may be loaded into memory 704 and executed by a processor 702 in a manner known in the art.

The computer system 700 may include fewer components than illustrated, additional components not illustrated herein, or some combination of the components illustrated and additional components. Computer system 700 may be or include any computing device known in the art, such as a mainframe, server, personal computer, workstation, laptop, handheld or mobile computer, tablet, wearable device, telephony device, network appliance (such as an edge appliance), virtualization device, storage controller, etc.

Figure 8:
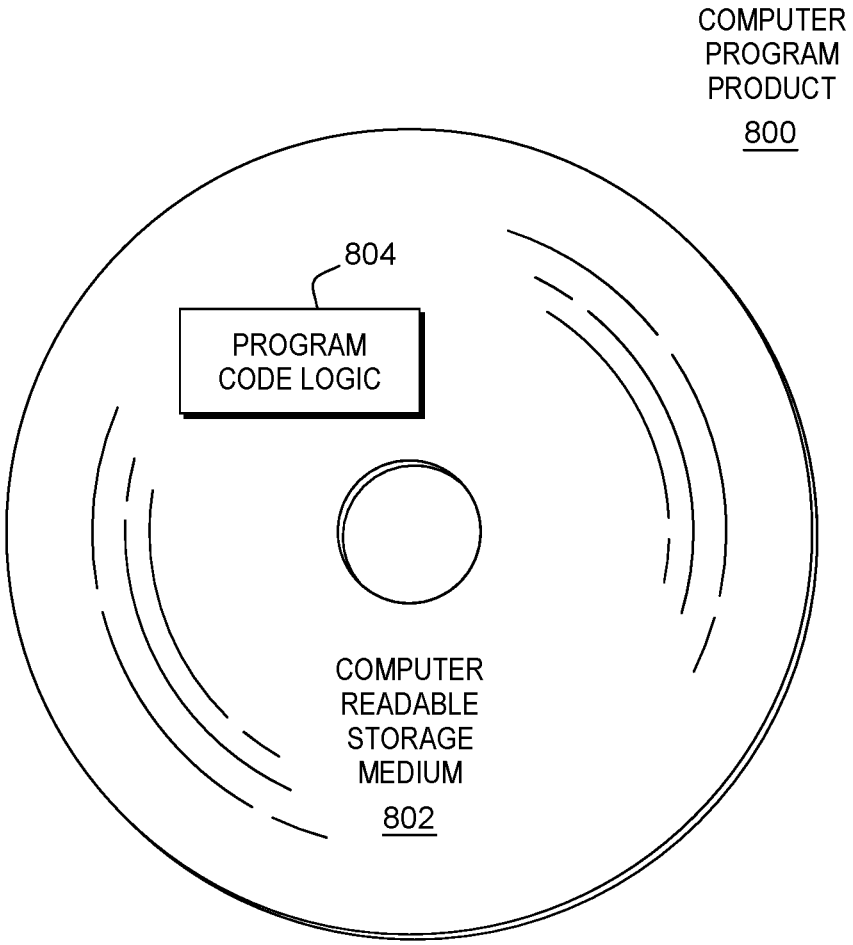
FIG. 8 depicts one embodiment of a computer program product.

Referring to FIG. 8, in one example, a computer program product 800 includes, for instance, one or more computer readable storage media 802 to store computer readable program code means, logic and/or instructions 804 thereon to provide and facilitate one or more embodiments.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the claims below, if any, are intended to include any structure, material, or act for performing the function in combination with other claimed elements as specifically claimed. The description of one or more embodiments has been presented for purposes of illustration and description, but is not intended to be exhaustive or limited to in the form disclosed. Many modifications and variations will be apparent to those of ordinary skill in the art. The embodiment was chosen and described in order to best explain various aspects and the practical application, and to enable others of ordinary skill in the art to understand various embodiments with various modifications as are suited to the particular use contemplated.

What is claimed is:

1. A computer-implemented method comprising:

identifying traffic in an area, the traffic comprising traffic objects, and the identifying comprising obtaining traffic object identifiers of traffic objects in the area, each traffic object of the traffic objects being identified by a respective traffic object identifier, of the traffic object identifiers, received from the traffic object;

dynamically assigning traffic object weights to the traffic objects based on pre-established traffic criteria, each traffic object being assigned a respective traffic object weight of the dynamically assigned traffic object weights, the pre-established traffic criteria each comprising at least one weight value, wherein the traffic object weight assigned to a traffic object of the traffic objects is based on the weight values of a set of traffic criteria, of the pre-established traffic criteria, applicable to the traffic object and reflects a level of prioritization of a right-of-way of the traffic object, and wherein a first set of traffic criteria contributing to the traffic object weight of one traffic object of the traffic objects is different from a second set of traffic criteria contributing to the traffic object weight of another traffic object of the traffic objects; and controlling flow of the traffic in the area, the controlling the flow comprising controlling at least one electronic traffic control signal based at least in part on the dynamically assigned traffic object weights.

2. The method of claim 1, wherein the obtaining the traffic object identifiers comprises using one or more sensors positioned proximate an intersection in the area to detect the traffic object identifiers as the traffic objects approach the intersection, wherein the method further comprises obtaining the dynamically assigned traffic object weights of the traffic objects together with the traffic object identifiers as the traffic objects approach the intersection, and wherein controlling the flow of the traffic controls the at least one traffic control signal to control the movement of the traffic objects through the intersection.

3. The method of claim 2, wherein controlling the movement of the traffic objects through the intersection comprises:

determining, for each direction of at least two directions through the intersection controlled by the at least one traffic signal, a total priority of traffic objects proceeding in the respective direction, based on the dynamically assigned traffic object weights of traffic objects proceeding in that direction;

determining, based on the obtained total priorities of traffic objects proceeding in the at least two directions, a traffic flow through the intersection, the traffic flow comprising a sequence of the at least two directions prioritized by total priority of traffic objects proceeding in each direction; and controlling the traffic signal to realize the determined traffic flow, wherein right-of-way through the intersection proceeds through the prioritized sequence of the at least two directions.

4. The method of claim 2, further comprising receiving a list of traffic object identifiers of traffic objects proceeding through the intersection in a direction away from the intersection, and providing an indication of the traffic objects and traffic object weights of the traffic objects to at least one other traffic control signal of another intersection to which the traffic objects are proceeding, to facilitate pre-planning of traffic control by the at least one other traffic control signal in controlling flow of the traffic objects through the another intersection.

5. The method of claim 2, further comprising obtaining information about a pending roadway condition of a roadway in a direction away from the intersection, wherein the controlling is further based on the information about the pending roadway condition, wherein the controlling lowers a level of prioritization in passing particular traffic through the intersection in the direction or diverts the particular traffic from passing through the intersection in the direction, based on a type or characteristic of that particular traffic.

6. The method of claim 1, further comprising:

monitoring the traffic object passing through a first intersection in the area;

identifying an infraction committed by the traffic object; and modifying the traffic object weight assigned to the traffic object based on the infraction, the modifying decreasing the level of prioritization of the right-of-way of the traffic object.

7. The method of claim 1, wherein the traffic objects comprise vehicle traffic objects and non-vehicle traffic objects, wherein the controlling prioritizes right-of-way of the vehicle traffic objects and of the non-vehicle traffic objects relative to each other.

8. The method of claim 1, wherein a traffic object of the traffic objects comprises a motorized vehicle with one or more passengers, wherein the method further comprises dynamically assigning a weight to each passenger of the one or more passengers based on the pre-established traffic criteria, and wherein the traffic object weight of the motorized vehicle is based further on the dynamically assigned weight of each passenger of the one or more passengers.

9. The method of claim 1, wherein a traffic object of the traffic objects comprises a motorized vehicle with a number of passengers, and wherein the traffic object weight of the motorized vehicle is based further on a ratio of the number of passengers of the motorized vehicle to a number of passengers the motorized vehicle is equipped to accommodate, wherein a lower ratio results in a lower traffic object weight.

10. The method of claim 1, further comprising configuring priority parameters of a roadway or route in the area to deprioritize use of the roadway or route by traffic objects subject to the priority parameters.

11. A computer program product comprising:

a computer readable storage medium readable by a processor and storing instructions for execution by the processor for performing a method comprising:

identifying traffic in an area, the traffic comprising traffic objects, and the identifying comprising obtaining traffic object identifiers of traffic objects in the area, each traffic object of the traffic objects being identified by a respective traffic object identifier, of the traffic object identifiers, received from the traffic object;

dynamically assigning traffic object weights to the traffic objects based on pre-established traffic criteria, each traffic object being assigned a respective traffic object weight of the dynamically assigned traffic object weights, the pre-established traffic criteria each comprising at least one weight value, wherein the traffic object weight assigned to a traffic object of the traffic objects is based on the weight values of a set of traffic criteria, of the pre-established traffic criteria, applicable to the traffic object and reflects a level of prioritization of a right-of-way of the traffic object, and wherein a first set of traffic criteria contributing to the traffic object weight of one traffic object of the traffic objects is different from a second set of traffic criteria contributing to the traffic object weight of another traffic object of the traffic objects; and controlling flow of the traffic in the area, the controlling the flow comprising controlling at least one electronic traffic control signal based at least in part on the dynamically assigned traffic object weights.

12. The computer program product of claim 11, wherein the obtaining the traffic object identifiers comprises using one or more sensors positioned proximate an intersection in the area to detect the traffic object identifiers as the traffic objects approach the intersection, wherein the method further comprises obtaining the dynamically assigned traffic object weights of the traffic objects together with the traffic object identifiers as the traffic objects approach the intersection, and wherein controlling the flow of the traffic controls the at least one traffic control signal to control the movement of the traffic objects through the intersection.

13. The computer program product of claim 12, wherein controlling the movement of the traffic objects through the intersection comprises:

determining, for each direction of at least two directions through the intersection controlled by the at least one traffic signal, a total priority of traffic objects proceeding in the respective direction, based on the dynamically assigned traffic object weights of traffic objects proceeding in that direction;

determining, based on the obtained total priorities of traffic objects proceeding in the at least two directions, a traffic flow through the intersection, the traffic flow comprising a sequence of the at least two directions prioritized by total priority of traffic objects proceeding in each direction; and controlling the traffic signal to realize the determined traffic flow, wherein right-of-way through the intersection proceeds through the prioritized sequence of the at least two directions.

14. The computer program product of claim 12, wherein the method further comprises receiving a list of traffic object identifiers of traffic objects proceeding through the intersection in a direction away from the intersection, and providing an indication of the traffic objects and traffic object weights of the traffic objects to at least one other traffic control signal of another intersection to which the traffic objects are proceeding, to facilitate pre-planning of traffic control by the at least one other traffic control signal in controlling flow of the traffic objects through the another intersection.

15. The computer program product of claim 11, wherein the traffic objects comprise vehicle traffic objects and non-vehicle traffic objects, wherein the controlling prioritizes right-of-way of the vehicle traffic objects and of the non-vehicle traffic objects relative to each other.

16. A computer system comprising:

a memory; and a processor in communication with the memory, wherein the computer system is configured to perform a method, the method comprising:

identifying traffic in an area, the traffic comprising traffic objects, and the identifying comprising obtaining traffic object identifiers of traffic objects in the area, each traffic object of the traffic objects being identified by a respective traffic object identifier, of the traffic object identifiers, received from the traffic object;

dynamically assigning traffic object weights to the traffic objects based on pre-established traffic criteria, each traffic object being assigned a respective traffic object weight of the dynamically assigned traffic object weights, the pre-established traffic criteria each comprising at least one weight value, wherein the traffic object weight assigned to a traffic object of the traffic objects is based on the weight values of a set of traffic criteria, of the pre-established traffic criteria, applicable to the traffic object and reflects a level of prioritization of a right-of-way of the traffic object, and wherein a first set of traffic criteria contributing to the traffic object weight of one traffic object of the traffic objects is different from a second set of traffic criteria contributing to the traffic object weight of another traffic object of the traffic objects; and controlling flow of the traffic in the area, the controlling the flow comprising controlling at least one electronic control signal based at least in part on the dynamically assigned traffic object weights.

17. The computer system of claim 16, wherein the obtaining the traffic object identifiers comprises using one or more sensors positioned proximate an intersection in the area to detect the traffic object identifiers as the traffic objects approach the intersection, wherein the method further comprises obtaining the dynamically assigned traffic object weights of the traffic objects together with the traffic object identifiers as the traffic objects approach the intersection, and wherein controlling the flow of the traffic controls the at least one traffic control signal to control the movement of the traffic objects through the intersection.

18. The computer system of claim 17, wherein controlling the movement of the traffic objects through the intersection comprises:

determining, for each direction of at least two directions through the intersection controlled by the at least one traffic signal, a total priority of traffic objects proceeding in the respective direction, based on the dynamically assigned traffic object weights of traffic objects proceeding in that direction;

determining, based on the obtained total priorities of traffic objects proceeding in the at least two directions, a traffic flow through the intersection, the traffic flow comprising a sequence of the at least two directions prioritized by total priority of traffic objects proceeding in each direction; and controlling the traffic signal to realize the determined traffic flow, wherein right-of-way through the intersection proceeds through the prioritized sequence of the at least two directions.

19. The computer system of claim 17, wherein the method further comprises receiving a list of traffic object identifiers of traffic objects proceeding through the intersection in a direction away from the intersection, and providing an indication of the traffic objects and traffic object weights of the traffic objects to at least one other traffic control signal of another intersection to which the traffic objects are proceeding, to facilitate pre-planning of traffic control by the at least one other traffic control signal in controlling flow of the traffic objects through the another intersection.

20. The method of claim 1, wherein the respective traffic object identifier is received from a device of the traffic object.

* * * * *